US010535932B2

(12) United States Patent
France et al.

(10) Patent No.: US 10,535,932 B2
(45) Date of Patent: Jan. 14, 2020

(54) ELECTRIC APPARATUS WITH A PUSH-IN CONNECTION TERMINAL MOUNTED IN A CASING WITH TWO PORTIONS ASSEMBLED ALONG THE INSERTION DIRECTION OF AN ELECTRICAL CONDUCTOR IN THE CONNECTION TERMINAL

(71) Applicant: ABB SCHWEIZ AG, Baden (CH)

(72) Inventors: Philippe France, Chazelles sur Lyons (FR); Romain Villard, Saint Priest (FR); Moine Geoffrey, Lyons (FR)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/432,540

(22) Filed: Feb. 14, 2017

(65) Prior Publication Data

US 2017/0237184 A1 Aug. 17, 2017

(30) Foreign Application Priority Data

Feb. 15, 2016 (EP) ..... 16305167

(51) Int. Cl.
*H01R 4/48* (2006.01)
*H01R 9/26* (2006.01)

(52) U.S. Cl.
CPC ..... *H01R 4/4818* (2013.01); *H01R 4/4827* (2013.01); *H01R 9/26* (2013.01)

(58) Field of Classification Search
CPC ..... H01R 4/4845; H01R 4/48; H01R 4/4827; H01R 4/4818

(Continued)

(56) References Cited

U.S. PATENT DOCUMENTS 5,975,940 A 11/1999 Hartmann et al.
7,255,592 B1 * 8/2007 Tseng ..... H01R 4/22 439/439

(Continued)

FOREIGN PATENT DOCUMENTS

CN 102969592 A 3/2013
DE 102012101449 A1 8/2013

(Continued)

OTHER PUBLICATIONS

European Search Report for International Application No. EP16305167 dated Jun. 30, 2016, 2 pages.

(Continued)

*Primary Examiner* — Abdullah A Riyami
*Assistant Examiner* — Thang H Nguyen
(74) *Attorney, Agent, or Firm* — Cantor Colburn LLP

(57) ABSTRACT

An electrical contactor a casing formed of an electrically insulating material and at least one connection terminal mounted in the casing configured to establish and maintain a contact between an electrical conductor inserted in the connection terminal and an electrical link bar mounted in the casing to ensure an electrical connection between the electrical link bar and the electrical conductor. The connection terminal having a contact spring configured so that the contact between the electrical conductor and the electrical link bar results from a force insertion of the electrical conductor in opposition to the action of the contact spring and is automatically maintained by the contact spring after insertion of the electrical conductor. The casing has a peripheral wall and a cover configured to be assembled together along a mounting direction substantially parallel to the direction in which the electrical conductor is inserted in the connection terminal.

16 Claims, 3 Drawing Sheets

(58) Field of Classification Search
USPC ..... 439/834, 835, 436–438, 440, 441
See application file for complete search history.

(56) References Cited

U.S. PATENT DOCUMENTS

| | | | | |
|---|---|---|---|---|
| 7,704,095 | B2 * | 4/2010 | Stromiedel | H01R 4/4818 439/436 |
| 7,766,689 | B2 * | 8/2010 | Knoerrchen | H01R 4/4836 439/437 |
| 7,896,685 | B2 * | 3/2011 | Eppe | H01H 1/5844 439/441 |
| 9,774,107 | B2 * | 9/2017 | Kamo | H01R 9/2416 |
| 2006/0063420 | A1 * | 3/2006 | Reibke | H01R 4/4827 439/441 |
| 2007/0072481 | A1 * | 3/2007 | Edenharter | H01R 4/4818 439/441 |
| 2007/0099479 | A1 * | 5/2007 | Holterhoff | H01R 4/4836 439/441 |
| 2008/0020628 | A1 * | 1/2008 | Kikuchi | H01R 4/4836 439/441 |
| 2010/0075533 | A1 * | 3/2010 | Weaver | H01R 4/2404 439/532 |
| 2010/0081316 | A1 * | 4/2010 | Eppe | H01H 1/5844 439/441 |
| 2010/0221941 | A1 * | 9/2010 | Andersen | H01R 13/112 439/251 |
| 2011/0312228 | A1 * | 12/2011 | Schrader | H01R 4/4827 439/733.1 |
| 2012/0208394 | A1 * | 8/2012 | Tseng | H01R 4/4818 439/438 |
| 2014/0065892 | A1 * | 3/2014 | Jun | H01R 4/4827 439/787 |
| 2014/0127932 | A1 | 5/2014 | Hoppmann et al. | |

FOREIGN PATENT DOCUMENTS

| | | | |
|---|---|---|---|
| EP | 1429418 | A1 | 6/2004 |
| FR | 2757687 | A1 | 6/1998 |

OTHER PUBLICATIONS

European Office Action for Application No. 16 305 167.5-1201 dated Mar. 21, 2019; 9 pgs.

* cited by examiner

ELECTRIC APPARATUS WITH A PUSH-IN CONNECTION TERMINAL MOUNTED IN A CASING WITH TWO PORTIONS ASSEMBLED ALONG THE INSERTION DIRECTION OF AN ELECTRICAL CONDUCTOR IN THE CONNECTION TERMINAL

CROSS REFERENCE TO RELATED APPLICATIONS

This application claims foreign priority under 35 U.S.C. § 119 to European Patent Application No. 16305167.5 filed on Feb. 15, 2016, the entire contents of which are incorporated herein by reference thereto.

BACKGROUND

The present invention concerns an electric apparatus such as a contactor, comprising a casing formed of an electrically insulating material and at least one connection terminal mounted in the casing and intended to establish and maintain a contact between an electrical conductor inserted in the connection terminal and an electrical link bar mounted in the casing to ensure an electrical connection between the electrical link bar and the electrical conductor.

The electric apparatus can alternatively be configured so as to constitute an engine starter.

In a known manner, in the constitution of such electric apparatuses, the electrically insulating casing is composed of a peripheral wall and of a cover which are assembled together. The elements of the connection terminal and the electrical link bar cannot be inserted laterally into the casing as is the case, for example, in the junction blocks. On the contrary, the elements of the connection terminal and the electrical link bar are forced to be mounted into the casing along a mounting direction substantially parallel to the direction in which the electrical conductor is provided to be inserted into the connection terminal.

This constraint brings a restriction in the freedom of designing the connection terminal and it can happen that the electric apparatus as a whole is not totally satisfactory, in particular in terms of cost, simplicity of design and use, ergonomics, overall dimension and weight.

The present invention aims to solve all or part of the disadvantages listed above.

BRIEF SUMMARY

In this context, there is a need to provide an electric apparatus corresponding to the technical field presented above and which allows to propose an alternative solution to the existing solutions, to improve characteristics such as the costs, the overall dimension and the weight, to be simple in design and use, while being user-friendly and ergonomic in practice.

For this purpose, there is proposed an electric apparatus such as a contactor, comprising a casing formed of an electrically insulating material and at least one connection terminal mounted in the casing and intended to establish and maintain a contact between an electrical conductor inserted in the connection terminal and an electrical link bar mounted in the casing to ensure an electrical connection between the electrical link bar and the electrical conductor, the connection terminal being of the push-in type and comprising a contact spring configured so that the contact between the electrical conductor and the electrical link bar results from a force insertion of the electrical conductor in opposition to the action of the contact spring and is automatically maintained by the contact spring after insertion of the electrical conductor.

According to a particular embodiment, the casing comprising a peripheral wall and a cover assembled together, and at least one insertion opening allowing inserting the electrical conductor into the casing until the connection terminal is at least partially delimited by the cover.

According to another embodiment, the peripheral wall and the cover are configured to be assembled together along a mounting direction forming an angle with the direction in which the electrical conductor is inserted in the connection terminal having a value less than 30°.

The contact spring and the casing can be configured so that the contact spring is mounted into the casing along a mounting direction substantially parallel to the direction in which the electrical conductor is inserted in the connection terminal.

According to a particular embodiment, the electric apparatus comprises blocking means secured to the cover configured to block the tilting of the contact spring relative to the casing during the insertion of the electrical conductor into the connection terminal and during the removal of the electrical conductor from the connection terminal.

The blocking means can comprise at least a first abutment delimited by the cover and configured so that the contact spring comes automatically in abutment against the first abutment in order to block the tilting of the contact spring in a first way during the insertion of the electrical conductor into the connection terminal.

According to another embodiment, the first abutment is arranged to block the contact spring along a longitudinal direction and or along a transverse direction of at least one blade of the contact spring.

The contact spring can comprise a protrusion extending laterally in the longitudinal direction of the blade and the first abutment can bear against said protrusion when the tilting of the contact spring is blocked in the first way.

According to a particular embodiment, the contact spring comprises two blades linked to each other by a link portion and the first abutment is transversely inserted in a slot separating the two blades from each other along a lateral direction of the blades and bears longitudinally and/or transversely against the link portion.

The blocking means can comprise a second abutment delimited by the cover and configured so that the contact spring comes automatically in abutment against the second abutment in order to block the tilting of the contact spring in a second way during the removal of the electrical conductor from the connection terminal.

According to another embodiment, the second abutment is located facing at least one blade of the contact spring along the transverse direction of said blade and is arranged to block the contact spring along the transverse direction.

BRIEF DESCRIPTION OF THE DRAWINGS

The invention will be well understood using the following description of particular embodiments of the invention given by way of non-restrictive examples and shown in the appended drawings, wherein.

DETAILED DESCRIPTION

Figure 1:
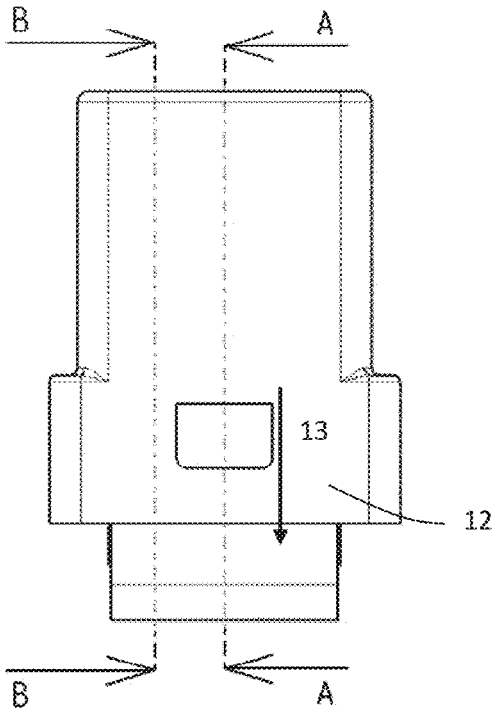
FIG. 1 illustrates in side view the cover of the casing of an example of an electric apparatus according to the invention.
Figure 2:
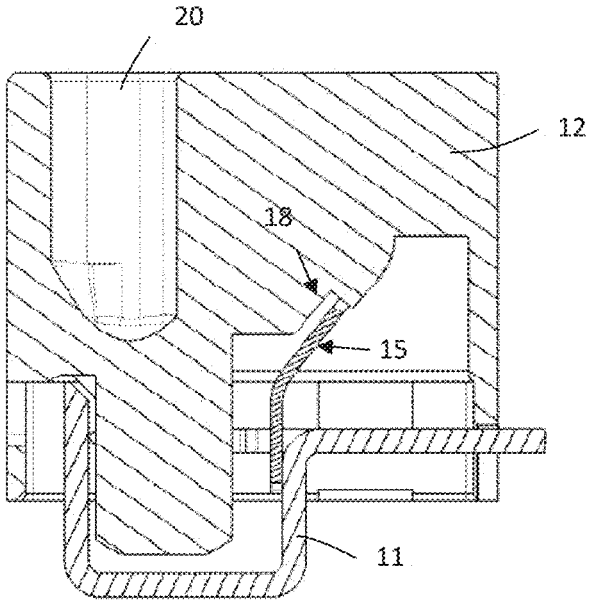
FIG. 2 shows the cover of FIG. 1 according to the section plane A-A shown in FIG. 1.
Figure 3:
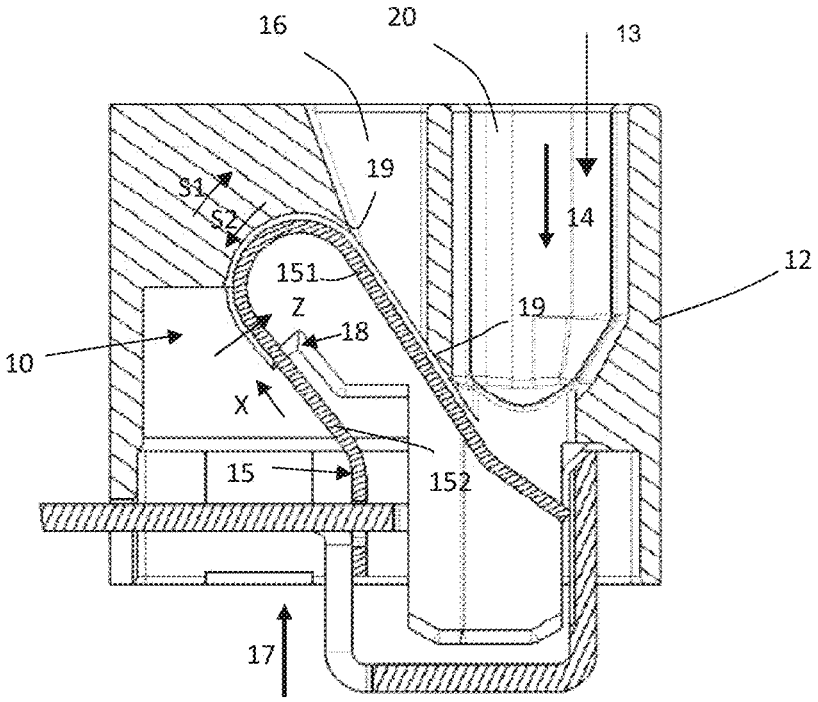
FIG. 3 shows the cover of FIG. 1 according to the section plane B-B shown in FIG. 1.
Figure 3A:
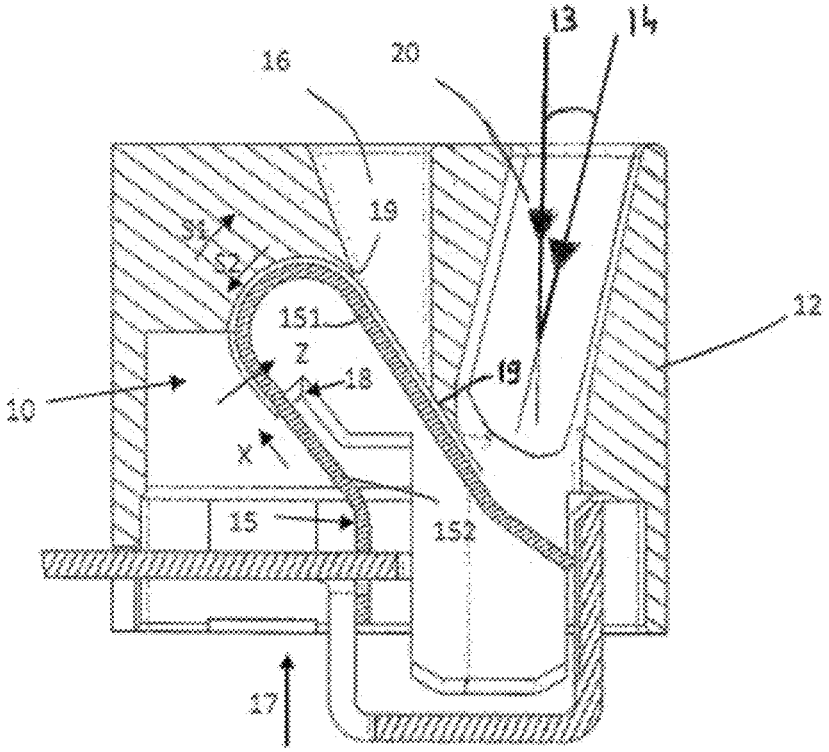
FIG. 3A is a cross-sectional view of the electric apparatus.

With reference to the appended FIGS. 1 to 3A as briefly presented above, the invention concerns essentially an electric apparatus comprising a casing formed of an electrically insulating material. The apparatus also comprises at least one connection terminal 10 mounted in the casing. The connection terminal 10 is intended to establish and maintain a contact between an electrical conductor (not shown) inserted in the connection terminal 10 and an electrical link bar 11 mounted in the casing, this physical contact having the function of ensuring an electrical connection between the electrical link bar 11 and the electrical conductor.

The electric apparatus can in particular and very advantageously be an electrical contactor or an engine starter.

The electrical conductor can in particular take the form of a sheathed or non-sheathed wire by an electrically insulating material.

In the case where the electric apparatus is of the type electrical contactor, it can comprise a maneuvering element (not shown), whose actuation allows selectively establishing or interrupting an electrical continuity. The electric apparatus can be configured to be fixed in a dismountable manner on a fixing rail on which several electric apparatuses can be mounted side by side, these electric apparatuses being identical or not to each other.

The casing comprises a peripheral wall (not shown) and a cover 12 assembled together. Consequently, the casing is only partially shown in FIGS. 1 to 3A, only the cover 12 being illustrated. The casing comprises means allowing inserting the electrical conductor in the casing, these means comprising at least one insertion opening 20 allowing inserting the electrical conductor in the casing up to the connection terminal 10. Said at least one insertion opening 20 is at least partially delimited by the cover 12.

In the advantageous but not exclusive illustrated variant, this insertion opening 20 is completely delimited by the cover 12.

The peripheral wall and the cover 12 are configured so as to be assembled together in a mounting direction 13 forming an angle with the direction 14 in which the electrical conductor is inserted in the connection terminal 10 having a value less than 30°.

In a particular case, the mounting direction 13 is substantially parallel to the direction 14 in which the electrical conductor is inserted in the connection terminal 10.

The term <<substantially parallel>> herein means <<exactly parallel>> or <<parallel to within 5°>>.

The assembling of the cover 12 with the peripheral wall can be carried out by any suitable mechanism such as a snapping, screwing or system or the like.

The electrical link bar 11 and the connection terminal 10 are both mounted in the cover 12 of the casing.

The connection terminal 10 is of the push-in type and comprises a contact spring 15 configured so that the contact between the electrical conductor and the electrical link bar 11 results from a force insertion of the electrical conductor in opposition to the action of the contact spring 15 and is automatically maintained by the contact spring 15 after insertion of the electrical conductor.

The insertion of the electrical conductor is practiced between a portion of the contact spring 15 and the electrical link bar 11, so that the electrical conductor is directly enclosed by and between these two parts.

The installation of the electrical conductor in the connection terminal 10 until establishing and maintaining the physical contact of the electrical conductor against the link bar 11 results from the fact that the electrical conductor is directly plugged between the contact spring 15 of the connection terminal 10 adapted for this purpose and the link bar 11, under the effect of an insertion force of the electrical conductor relative to this contact spring 15.

The contact spring 15 is capable of varying between a first rest configuration (shown in FIGS. 1 to 3A) from which it can be opened under the effect of the insertion action of the electrical conductor to adopt a second configuration (not shown) in which the contact spring 15 exerts a pressure force of the electrical conductor against the electrical link bar 11, and a third configuration in which the electrical conductor is free to be removed from the connection terminal 10. The variation of the contact spring 15 from one configuration to the other is made by elastic deformation of at least one of its portions. The contact spring 15 is configured to be continuously biased toward the first configuration by elastic return of its material. The pressure force exerted on the electrical conductor by the contact spring 15 in its second configuration is adapted to ensure maintaining the electrical conductor in the connection terminal 10, in particular by clamping between the contact spring 15 and the electrical link bar 11, to avoid its axial removal from the connection terminal 10.

The casing, in particular its cover 12, delimits an orifice 16 allowing the insertion of an unlocking tool (not shown) in the casing until lying against the contact spring 15 in an area thereof such that the passage of the contact spring 15 toward its third configuration results from a pressure action of the unlocking tool on this area of the contact spring 15 having an intensity greater than a predetermined value. This predetermined value depends on the design and organization of the contact spring 15.

According to a particular non-restrictive embodiment, the contact spring 15 and the casing are configured so that the contact spring 15 is mounted in the casing, in particular in the cover 12, along a mounting direction 17 substantially parallel to the direction 14 in which the electrical conductor is inserted in the connection terminal 10.

In order to stabilize the contact spring 15 relative to the casing, in particular in terms of rotation or translation in the space relative to the cover 12, the electric apparatus comprises blocking means secured to the cover 12 configured to block the tilting of the contact spring 15 relative to the casing during the insertion of the electrical conductor in the connection terminal 10 as well as during the removal of the electrical conductor from the connection terminal 10.

In order to confer such a function, the blocking means comprise at least a first abutment 18 delimited by the cover 12 and configured so that the contact spring 15 comes automatically in abutment against the first abutment 18 in order to block the tilting of the contact spring 15 in a first way S1 during the insertion of the electrical conductor in the connection terminal 10.

The nature and the design of the first abutment 18 is not restrictive in itself and it has been found, however, that good results are achieved when the first abutment 18 is arranged to block the contact spring 15 along a longitudinal direction X and/or along a transverse direction Z of at least one blade 151 of the contact spring 15.

In other words, the contact spring 15 can comprise at least one blade 151, which can extend in a curved manner along its length to form an elbow. The end of the blade 151 constitutes the portion of the contact spring 15 intended to bear against the electrical conductor in the second configuration of the spring 15. At least the elbow portion of each blade 151 forms the elastic portion dedicated to the passage from one configuration to the other of the contact spring 15. A "blade" corresponds to a substantially elongated portion, having a dimension larger than the other dimensions, similar to its length. The longitudinal direction X corresponds locally to the extension or elongation direction of the blade 151, along which the length is considered. The smallest dimension of the blade, similar to its thickness, is counted locally along the transverse direction Z. The directions X and Z are included in a plane parallel to the previously mentioned directions 13, 14, 17. The direction simultaneously perpendicular to the longitudinal direction X of the blade 151 and to its transverse direction Z is the lateral direction of the blade 151, extending horizontally in FIG. 1. The size of the blade 151, counted along the lateral direction of the blade 151, is similar to the width of the blade 151. The length of the blade 151 along the longitudinal direction X is much greater than the width of the blade 151 along its lateral direction, which is itself much greater than the thickness of the blade 151 counted along the transverse direction Z. The lateral direction is orthogonal to the previously mentioned directions 13, 14, 17.

According to an embodiment that is both simple and effective, the contact spring 15 comprises a protrusion extending laterally in the longitudinal direction X of the blade 151. The first abutment 18 can bear against this protrusion when the tilting of the contact spring 15 is blocked in the first way S1. In other words, this protrusion extends locally along the lateral direction of the blade 151. It forms a single piece from the rest of the blade 151 and extends projecting along the lateral direction relative to the rest of the blade 151. The first abutment 18 delimited by the cover 12 is formed in suitable manner so that this protrusion automatically bears against the first abutment 18 during the passage of the contact spring 15 toward the second configuration or toward the third configuration in order to avoid the tilting of the contact spring 15 along the first way S1.

Although it is possible that the number of blade 151 is strictly equal to 1, the shown variant provides that the contact spring 15 comprises two blades 151 linked to each other by a link portion 152. The first abutment 18 secured to the cover 12 is inserted transversely in a slot separating the two blades 151 together along the lateral direction of the blades 151 and bears longitudinally and/or transversely against the link portion 152.

The contact spring 15 is mounted on the electric link bar 11. It is specified that the mounting of the contact spring 15 on the bar 11 is carried out at the link portion 152 which comprises the mounting elements for this purpose.

In addition, the blocking means comprise at least one second abutment 19 delimited by the cover 12 and configured so that the contact spring 15 comes automatically in abutment against the second abutment 19 in order to block the tilting of the contact spring 15 in a second way S2, opposite to the first way S1, during the removal of the electrical conductor from the connection terminal 10.

Finally, the first way S1 of tilting of the contact spring 15, prevented by the first abutment 18, corresponds to a tilting of the spring 15 toward the front while the second way S2 of tilting of the contact spring 15, inhibited by the second abutment 19, corresponds to a tilting of the spring 15 toward the rear.

In the variant illustrated in the figures, the cover 12 delimits two second abutments 19, staggered for each blade 151 along its length, in particular in the area extending between the elbow it forms and its end intended to exert the pressure force on the electrical conductor.

Although the number, the nature and the design of each second abutment are in no way restrictive, the illustrated variant provides that the second abutment 19 is located facing at least one of the blades 151 of the contact spring 15 along the transverse direction Z of this blade 151 and is arranged to block the contact spring 15 along the transverse direction Z.

The invention which has just been described is an alternative solution to those of the prior art which provided for a blocking of the connection terminals by screwing. It allows a reduction in costs, in overall dimension and in weight. It is simple in design and use, while being user-friendly and ergonomic in practice.

Advantageously, each connection terminal 10 is of the push-in type, which allows to achieve very effectively the results desired hereinabove, in particular when the cover and the peripheral wall of the insulating casing must be assembled in the same direction as the insertion direction of the electrical conductor in the connection terminal, which is often the case for the contactors or the engine starters. The mounting and blocking means of the tilting 18, 19 of the contact spring 15 allow very advantageously a mounting of the push-in type connection terminal 10 and the link bar 11 in the cover 12 in the same direction as the direction along which the electrical conductor is inserted in the connection terminal and the direction along which the cover 12 is assembled with the peripheral wall.

It is recalled that the fixing means of the contact spring conventionally used in the push-in connection terminals of the prior art impose a lateral mounting of the contact spring and of the link bar in the casing along a lateral direction perpendicular to the insertion direction of the electrical conductor, which makes them unusable and unsuitable when, as is the case herein, the cover 12 is assembled with the peripheral wall in the same direction as the insertion of the electrical conductor in the connection terminal. The invention eliminates this problem.

What is claimed is:

1. An electrical contactor, comprising a casing formed of an electrically insulating material, at least one connection terminal mounted in the casing and intended to establish and maintain a contact between an electrical conductor inserted in the connection terminal and an electric link bar mounted in the casing in order to ensure an electrical connection between the electric link bar and the electrical conductor, wherein the connection terminal is of the push-in type and comprises a contact spring configured so that the contact between the electrical conductor and the electric link bar results from a force insertion of the electrical conductor in opposition to the action of the contact spring and is automatically maintained by the contact spring after insertion of the electrical conductor, wherein the casing comprises a peripheral wall and a cover that are assembled to one another in a mounting direction forming an angle with a direction in which the electrical conductor is inserted into the connection terminal, the angle being less than 30° and at least one insertion opening allowing insertion of the electrical conductor into the casing until the connection terminal is at least partially delimited by the cover and wherein the contact spring and the casing are configured so that the contact spring is mounted into the casing along a mounting direction substantially parallel to the direction in which the electrical conductor is inserted in the connection terminal.

2. The electrical contactor according to claim 1, wherein the electrical contactor comprises blocking means secured to the cover configured to block the tilting of the contact spring relative to the casing during the insertion of the electrical conductor into the connection terminal and during the removal of the electrical conductor from the connection terminal.

3. The electrical contactor according to claim 2, wherein the blocking means comprise at least one first abutment delimited by the cover and configured so that the contact spring comes automatically in abutment against the first abutment in order to block the tilting of the contact spring in a first way (S1) during the insertion of the electrical conductor into the connection terminal.

4. The electrical contactor according to claim 3, wherein the first abutment is arranged to block the contact spring along a longitudinal direction (X) and or along a transverse direction (Z) of at least one blade of the contact spring.

5. The electrical contactor according to claim 4, wherein the contact spring comprises a protrusion extending laterally in the longitudinal direction (X) of the blade and in that the first abutment bears against said protrusion when the tilting of the contact spring in the first way (S1) is blocked.

6. The electrical contactor according to claim 5, wherein the contact spring comprises two blades linked to each other by a link portion and in that the first abutment is inserted transversely in a gap separating the two blades together along a lateral direction of the blades and bears longitudinally and/or transversely against the link portion.

7. The electrical contactor according to claim 2, wherein the blocking means comprise a second abutment delimited by the cover and configured so that the contact spring comes automatically in abutment against the second abutment in order to block the tilting of the contact spring in a second way (S2) during the removal of the electrical conductor from the connection terminal.

8. The electrical contactor according to claim 7, wherein the second abutment is located facing at least one blade of the contact spring along the transverse direction (Y) of said blade and is arranged to block the contact spring along the transverse direction (Y).

9. The electrical contactor according to claim 1, wherein the contact spring and the casing are configured so that the contact spring is mounted into the casing along a mounting direction substantially parallel to the direction in which the electrical conductor is inserted in the connection terminal.

10. The electrical contactor according to claim 1, wherein the contact spring and the casing are configured so that the contact spring is mounted into the casing along a mounting direction substantially parallel to the direction in which the electrical conductor is inserted in the connection terminal.

11. The electrical contactor according to claim 1, wherein the electrical contactor comprises blocking means secured to the cover configured to block the tilting of the contact spring relative to the casing during the insertion of the electrical conductor into the connection terminal and during the removal of the electrical conductor from the connection terminal.

12. The electrical contactor according to claim 1, wherein the electrical contactor comprises blocking means secured to the cover configured to block the tilting of the contact spring relative to the casing during the insertion of the electrical conductor into the connection terminal and during the removal of the electrical conductor from the connection terminal.

13. The electrical contactor according to claim 1, wherein the electrical contactor comprises blocking means secured to the cover configured to block the tilting of the contact spring relative to the casing during the insertion of the electrical conductor into the connection terminal and during the removal of the electrical conductor from the connection terminal.

14. The electrical contactor according to claim 13, wherein the blocking means comprise at least one first abutment delimited by the cover and configured so that the contact spring comes automatically in abutment against the first abutment in order to block the tilting of the contact spring in a first way (S1) during the insertion of the electrical conductor into the connection terminal.

15. The electrical contactor according to claim 14, wherein the first abutment is arranged to block the contact spring along a longitudinal direction (X) and or along a transverse direction (Z) of at least one blade of the contact spring.

16. The electrical contactor according to claim 15, wherein the contact spring comprises a protrusion extending laterally in the longitudinal direction (X) of the blade and in that the first abutment bears against said protrusion when the tilting of the contact spring in the first way (S1) is blocked.

* * * * *